US009314680B2

(12) United States Patent
Ali et al.

(10) Patent No.: US 9,314,680 B2
(45) Date of Patent: Apr. 19, 2016

(54) GAMING SYSTEM AND RELATED METHOD

(71) Applicant: Anthony Ali, Troy, NY (US)

(72) Inventors: Anthony Ali, Troy, NY (US); David M. Cowan, Brooklyn, NY (US)

(73) Assignee: Anthony Ali, Troy, NY (US)

( * ) Notice: Subject to any disclaimer, the term of this patent is extended or adjusted under 35 U.S.C. 154(b) by 0 days.

(21) Appl. No.: 14/521,452

(22) Filed: Oct. 22, 2014

(65) Prior Publication Data

US 2015/0115531 A1 Apr. 30, 2015

Related U.S. Application Data

(60) Provisional application No. 61/895,026, filed on Oct. 24, 2013.

(51) Int. Cl.

| | |
|---|---|
| ***A63B 67/06*** | (2006.01) |
| ***A63B 71/06*** | (2006.01) |
| ***A63B 63/00*** | (2006.01) |

(52) U.S. Cl.

CPC ..... *A63B 67/06* (2013.01); *A63B 63/00* (2013.01); *A63B 71/0669* (2013.01); *A63B 71/0672* (2013.01); *A63B 2210/50* (2013.01)

(58) Field of Classification Search

CPC ..... A63B 65/00; A63B 65/12

USPC ..... 273/398–410, 317.7, 337, 383, 384, 273/389

See application file for complete search history.

(56) References Cited

U.S. PATENT DOCUMENTS 5,839,981 A * 11/1998 Rudell ..... A63B 63/083 273/384

2005/0127609 A1* 6/2005 Raslowsky ..... A63B 67/06 273/402

* cited by examiner

*Primary Examiner* — Gene Kim

*Assistant Examiner* — Rayshun Peng

(74) *Attorney, Agent, or Firm* — Sanjiva K. Reddy; King & Spalding LLP

(57) ABSTRACT

An exemplary gaming system, in one implementation, provides active interaction between one or more players and the gaming system. Such an exemplary gaming system includes a receptacle with one or more holes to receive first gaming objects thrown at it. Chambers attached to a rigid member on the receptacle receive and store second gaming objects that are later released into one or more different spatial directions. An intermediate surface operably connected to a mechanical or an electrical triggering mechanism is included in the receptacle. When the first gaming object falls into the receptacle and hits the intermediate surface, the intermediate surface causes activation of the triggering mechanism to directly or indirectly propel the second gaming objects, through the chambers, into one or more different spatial directions. A hand or foot lever allows players to reset the triggering mechanism for the next game.

20 Claims, 9 Drawing Sheets

GAMING SYSTEM AND RELATED METHOD

RELATED APPLICATION

This application is related to, cross-references, and claims priority from U.S. Provisional Application No. 61/895,026 filed on Oct. 24, 2013, the disclosure of which is incorporated by reference herein.

TECHNICAL FIELD

The present disclosure relates to a gaming system and a method for gaming using the gaming system in an outdoor or indoor environment, where players may continuously interact with the gaming system and score based on the continued interaction.

BACKGROUND

Various types of outdoor and indoor games and activities typically include one or more gaming systems which may be a passive component to the game. In an example, beanbag throwing games provide players with limited interaction based on throwing a beanbag into a designated area or a hole. Exemplary literature relating to such games may be found in U.S. Pat. Nos. 922,717; 3,628,793; 4,726,591; 6,866,268; 3,628,793; 4,974,858; 5,056,796; 7,607,666; and 5,553,862.

Furthermore, such games have been improved to include rolling objects into designated area or a holes. For example, U.S. Patent Publication 20120292851 discloses a method of rolling an object into different contraptions. However, socially, a passive game system lacks sufficient robust continued interaction between players and the game system, comprehensive multi-player support, and variations of play.

SUMMARY

The present disclosure relates to a gaming system and a method for gaming using the gaming system in an outdoor or indoor environment, where the gaming system provides one or more players with active and continued interaction with each other and the game system, and also provides variations of play using the same gaming system.

In an exemplary implementation, the gaming system includes a receptacle with a top surface, a bottom surface, and one or more side surfaces. The top surface includes one or more holes, the one or more holes allow the receptacle to receive one or more first gaming objects. Further, one or more chambers are provided to receive and store one or more second gaming objects. Each of the one or more chambers has an open distal end through which to receive or release the one or more second gaming objects. Each of the one or more chambers also has a closed or at least partially open proximal end and has its proximal end attached to a rigid member. The rigid member is also attached to the one or more surfaces of the receptacle. The rigid member has an optional sectional opening member that is coincidental with the proximal end or the distal end of each of the one or more chambers. The rigid member allows a triggering mechanism, which is typically attached to a mechanically releasable latch or is in an electrically "off" state, to directly or indirectly access the proximal end of the one or more chambers, when triggered. An intermediate surface within the receptacle is operably connected to trigger the triggering mechanism and is anchored to an inside portion of one or more of the surfaces of the receptacle. Further, the intermediate surface receives and retains the one or more first gaming objects received into the receptacle, where the receipt of the one or more first gaming objects on the intermediate surface causes direct or indirect activation of the triggering mechanism to directly or indirectly access the rigid member and the one or more chambers. The activated triggering mechanism causes propulsion of the one or more second gaming objects, through the open distal end of the one or more chambers, into one or more different spatial directions In another exemplary implementation, a gaming method and associated scoring is disclosed. The method may use the gaming system disclosed above. The method includes, storing, in one or more chambers of a receptacle, one or more second gaming objects. In one step, the method includes setting, within the receptacle, a triggering mechanism into a mechanically releasable latch or into an electrically "off" state. The triggering mechanism is set such that it is mechanically unlatched or electrically turned "on," directly or indirectly, by an action of one or more first gaming objects falling onto an intermediate surface within the receptacle. The intermediate surface is operably connected to trigger the triggering mechanism. Further, the method includes, receiving, through a hole in the receptacle, the one or more first gaming objects. Thereafter the game method receives and retains, on the intermediate surface, the received one or more first gaming objects from the hole. The receipt of the one or more first gaming objects on the intermediate surface, directly or indirectly, causes direct or indirect activation of the triggering mechanism, where the activated triggering mechanism is unlatched from the mechanically releasable latch or is electrically switched from an "off" state to an "on" state. Further, the game features propelling, directly or indirectly by the triggering mechanism, the one or more second gaming objects into one or more spatial directions. The game is typically scored by the number of the one or more second gaming objects retrieved at one of: during the game, during a predetermined time period, or prior to the one or more second gaming objects touching any surface of any environmental object.

In yet another exemplary implementation, the receptacle of the gaming system has four flat side surfaces. In another exemplary implementation, the receptacle is shaped similar to a wedge, with four side surfaces, and with the top surface sloped from one side of the receptacle, along its length, to the other side of the receptacle. In other exemplary implementations, one or more of the top surface, the bottom surface, and the one or more side surfaces are made from one or more individual panels of wood, plastic, rubber, or metal, and optionally, with gaps there between. In yet other exemplary implementations, at least one of the one or more chambers is a cylindrically-shaped chamber.

In other exemplary implementations, the at least partially open proximal end of each chamber is a slot starting from the proximal end, extending laterally across the chamber, and extending half-way through the length of the chamber. Also, the slot is typically smaller than the smallest dimensions of the one or more second gaming objects and therefore retains the one or more second gaming objects within the chamber. Further, the slot accepts, directly or indirectly, the triggering mechanism. Further, in one example, the first gaming objects are small bags including a filler and are sized to fit into the hole. The small bags are typically made of one or more of cloth, leather, and a synthetic material. The filler is typically one or more of polystyrene beads, dried beans, metal pellets, wood pellets, and foam. In other examples, the one or more second gaming objects are spherical objects or bags comprising fillers. Typical spherical objects or bags comprising fillers are one or more of ping-pong balls, sponge balls, golf balls, beanbags, and high-bounce balls.

In yet other exemplary implementations, the intermediate surface is a plate of any shape and is sized to hold the one or more first gaming objects. Further, the opening in the rigid member typically accepts, directly or indirectly, the triggering mechanism. In another exemplary implementation, the triggering mechanism is typically one or more of a slat under bending stress; an air pressure created by an unwinding object or an object coming out of stress; an electric blower with "on-off" capability; an electric throwing apparatus comprising motorized opposing rollers with a gap there between; a material under elastic stress; a magnetically or electromagnetically induced release; a compressed spring at the proximal end of each chamber and a removable cover over its distal opening; and a spring under compression. In other examples of the gaming system of the present disclosure, the releasable latch is a first notch in a rotatable wheel. The wheel rotates in a radial release direction of the triggering mechanism. The rotatable wheel is typically held in a latched position with an edge of a structural member releasably locked into a second notch of the wheel, where the edge of the structural member is operably connected to the intermediate surface, and where the edge of the structural member is released from the second notch when the intermediate surface receives the one or more first gaming objects. The release of the edge of the structural member from the second notch causes the wheel to rotate, releasing the latch from the first notch into the radial release direction, and causing the triggering mechanism to, directly or indirectly, propel the one or more second objects through the open distal end of the one or more chambers. In yet another example of the implementation in the present gaming system, the triggering mechanism is reset or cocked by a foot or hand lever. The foot or hand lever is typically connected to a spring-loaded structural member and depressing the foot or hand lever mechanically causes the edge of the structural member to latch the triggering mechanism into a stressed state or electrically switches the triggering mechanism into an "off" state, thereby resetting the triggering mechanism.

In yet another exemplary implementation, the triggering mechanism indirectly accesses the at least partially open proximal end of the one or more chambers using air from an electric blower, which is electrically switched to an "on" state during activation, thereby blowing air to release the one or more second gaming objects, through the open distal end of the one or more chambers, into one or more different spatial directions. In another exemplary variation, the triggering mechanism directly accesses the at least partially open proximal end of the one or more chambers using a bent slat, which mechanically de-stresses during activation, thereby straightening into the at least partially open proximal end of the one or more chambers and striking the one or more second gaming objects to push it through the open distal end of the one or more chambers, into one or more different spatial directions.

BRIEF DESCRIPTION OF THE DRAWINGS

The accompanying drawings constitute a part of this specification and together with the specification, illustrate certain exemplary implementations of this disclosure.

DETAILED DESCRIPTION

Reference will now be made in detail to exemplary embodiments, which are illustrated in the accompanying drawings.

Figure 1A:
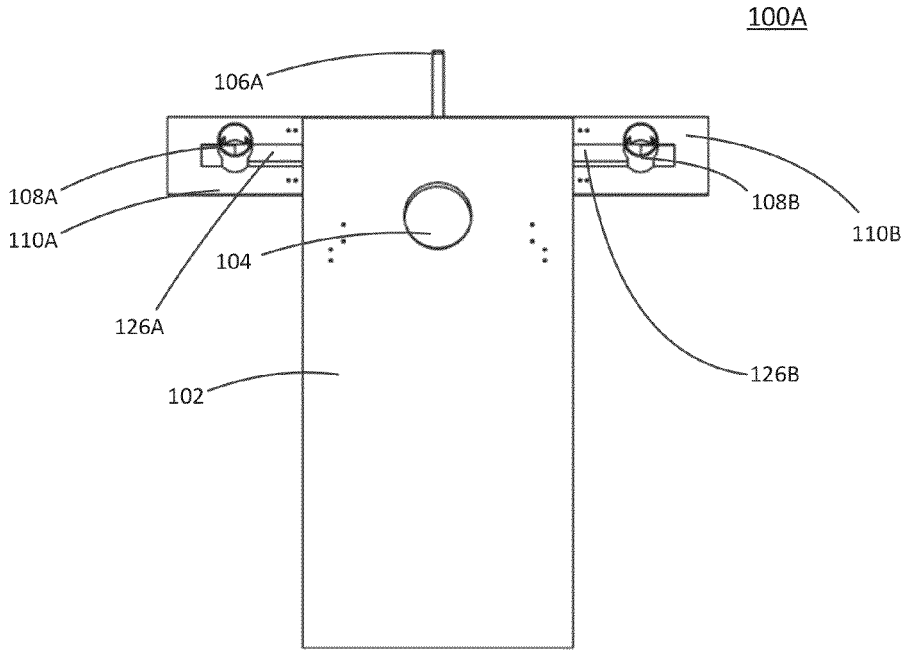
FIGS. 1A and 1B illustrate a plan view and a bottom view of a receptacle of a gaming system respectfully in accordance with an exemplary embodiment.
Figure 1B:
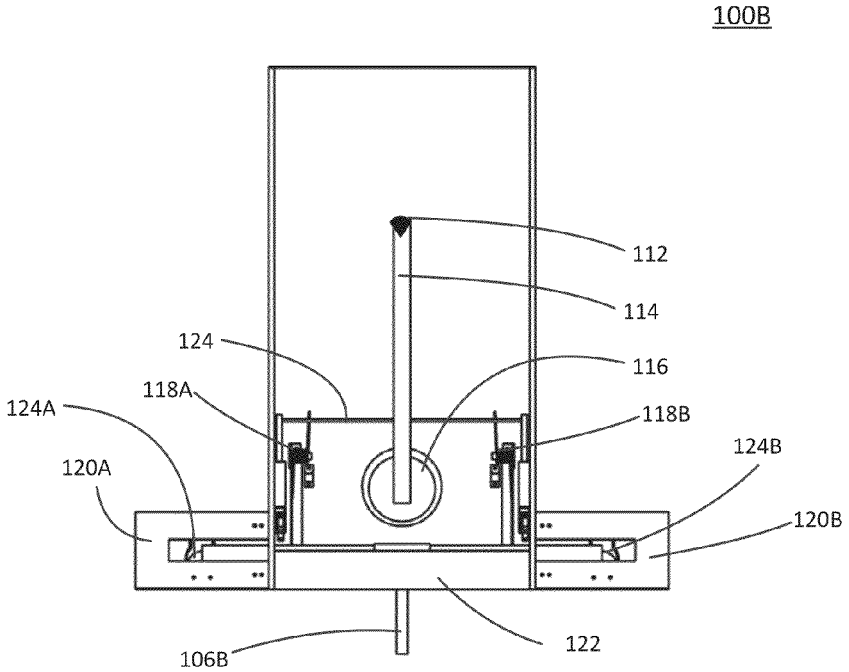

FIGS. 1A and 1B illustrate a plan view and a bottom view, respectfully, of a receptacle 100A-B of a gaming system, in accordance with an exemplary embodiment. The gaming system includes receptacle 100A-B, made of a top surface 102, a bottom surface 122, and one or more side surfaces, which are illustrated as drawing elements 208 and 214 of FIG. 2. The top surface 102 includes one or more holes 104. The one or more holes 104 allow the receptacle 100A-B to receive one or more first gaming objects. In an exemplary implementation, the first gaming objects are small bags filled with a filler material and are sized to fit into the hole 104. Such bags are typically made of made of one or more of cloth, leather, and a synthetic material. Further, such filler material is one or more of polystyrene beads, dried beans, metal pellets, wood pellets, and foam. The first gaming objects may be thrown, dropped, or rolled into the hole 104 by a player of the game system.

Further, one or more chambers 108A-B are provided to receive and store one or more second gaming objects. In an exemplary implementation, the second gaming objects are spherical objects or bags comprising fillers, including one or more of ping-pong balls, sponge balls, golf balls, beanbags, and high-bounce balls. Each of the one or more chambers 108A-B has an open distal end, illustrated as the top of the chambers 108A-B in FIG. 1A, through which the chambers receive or release the one or more second gaming objects. Each of the one or more chambers 108A-B also has a closed or at least partially open proximal end, which is at the bottom of the chamber 108A-B. The partial opening 124A-B is illustrated in the bottom view of the receptacle 100B. The partial opening of the proximal end is aligned to fully or partially coincide with a sectional opening of a rigid member, illustrated as 110A-B and 120A-B. The rigid member 110A-B and 120A-B may optionally include a separate sectional opening member 126A-B over the rigid member 110A-B and 120A-B, where the sectional opening of the rigid member coincides with the sectional opening member, and which allows a triggering mechanism to directly or indirectly access the chamber 108A-B.

Figure 9:
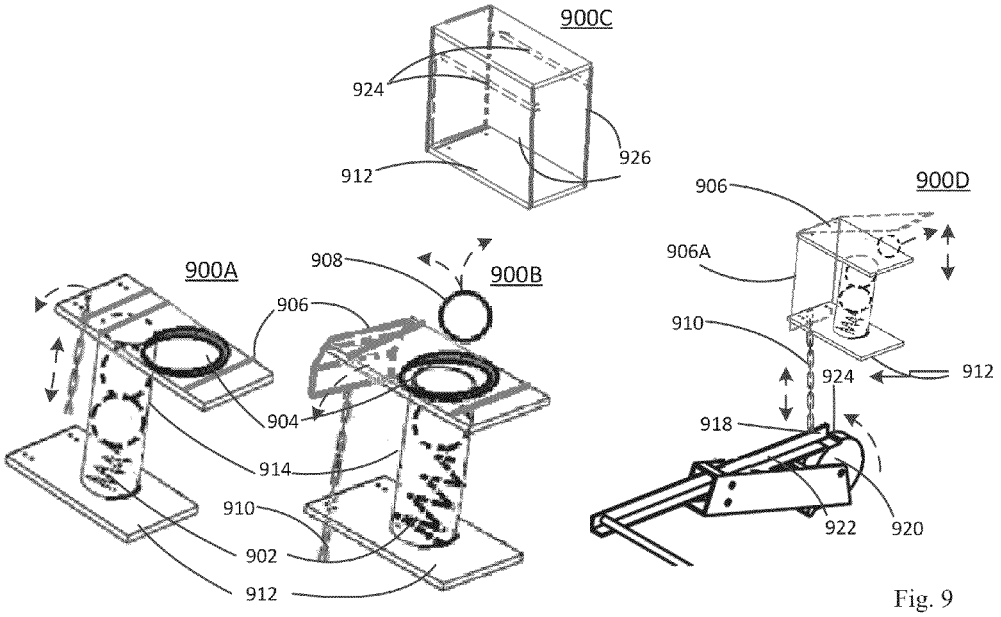

In an example, the sectional opening member may be an C-shaped thin piece of material that is attached to a slot in the rigid member to provide a sectional opening gap to the rigid member 110A-B and 120A-B. Further, the sectional opening member may be part of the rigid member. Throughout this disclosure, unless indicated otherwise, the "sectional opening member" is part of the "rigid member." Also, as is illustrated in FIG. 9 and its related discussion, the sectional opening member may include a further side member. In such cases, the side member and the sectional opening member are held by the rigid member and are considered part of the rigid member, unless indicated otherwise. The rigid member 110A-B and 120A-B is typically attached to the one or more surfaces 102, 122, 208, and 214 of the receptacle 100A-B. In an exemplary implementation, the proximal ends of the chambers are closed and includes a spring in each, which allows the chambers to be spring loaded and the rigid member to include a sectional opening member forming as a cover over the distal opening. The sectional opening member holds the spring loaded second gaming objects within the chambers in a stressed position.

In an exemplary implementation the one or more surfaces 102, 122, 208, 214, as well the rigid member 110A-B, the optional sectional opening member 126A-B, and the chambers 108A-B are made from one or more individual panels of wood, plastic, rubber, or metal, with optional gaps there between, and with each panel shaped in accordance to the illustrations with dimensions to fit their respective structures as discussed herein. In one example, the bottom surface 122 is illustrated as a single narrow panel with a gap large enough that the remaining portion of the bottom surface of the receptacle is left open. However, this gap may also be small enough to allow the bottom surface to appear fully closed, where multiple individual panels are fixed side-by-side along the entire bottom of the receptacle 100A-B. Further, in an example, the panels may be removable to access the components of the receptacle 100A-B from the bottom.

In an exemplary implementation, the triggering mechanism is reset or cocked by a foot or hand lever 106A-B extending outside the receptacle for easy access. The hand and foot lever 106A-B is connected to a structural member that is spring-loaded using springs illustrated as 118A-B. Where the foot or hand lever 106A-B is depressed, it causes the triggering mechanism to mechanically latch into a stressed state, or if an electrical triggering mechanism is used, the electrical trigger mechanism is switched into an "off" state, thereby resetting the triggering mechanism. This is illustrated in FIGS. 4-8 and is described in the sections relating to these figures. The noun "latch" as used throughout this disclosure, unless indicated otherwise, refers to any fastening device, physical members, or artifacts, which interlock together, including physical members such as structural beam members, slats, wheel members with edges, notches, latches, crevices, and other related artifacts that interlock or offer to interlock with other devices or members. Throughout this disclosure, the verbs "latch," "unlatch," and its tenses are used to indicate instances where an action of fastening or unfastening is occurring or has occurred. For example, a spring may function as a spring only when compressed or wound-up prior to latching in a latched (or locked) position with a latch, till it is ready to be triggered as part of a triggering mechanism. Accordingly, a triggering mechanism may include the actual spring and the release for the spring.

In an exemplary implementation, when triggered, the triggering mechanism will directly or indirectly access the partially open proximal end of the one or more chambers 108A-B. An intermediate surface, the bottom of which is illustrated as element 116 in the bottom view FIG. 1B, within the receptacle 100A-B, is operably connected to the triggering mechanism and is anchored to an inside portion of one or more of the surfaces of the receptacle 102, 122, 208, and 214. Throughout this disclosure, unless indicated otherwise, the term "operably" is used to reflect that while intermediate components may exist between a first component and a second component of the gaming system disclosed here, any action on the first component causes an action on the second component. Accordingly, the first component is operably connected to the second component. The intermediate components may provide a direct or indirect action between the first and second components. In one example, with respect to the current disclosure, the intermediate surface is operably connected to the triggering mechanism, where an action to depress the intermediate surface downwards causes a triggering action on the triggering mechanism.

Further, the intermediate surface 116 receives and retains the one or more first gaming objects received into the receptacle. The receipt and retention of the one or more first gaming objects on the intermediate surface 116 causes activation of the triggering mechanism to directly or indirectly access the opening in the rigid member 124A-B and 126A-B, and the partial opening in the one or more chambers 108A-B. Throughout this disclosure, the terms "activated" and "activation" are used interchangeably with the terms "trigger," "triggered," or "triggering," all to imply that the triggering mechanism is active and functioning. The triggering mechanism causes the release of the one or more second gaming objects, through the open distal end of the one or more chambers 108A-B, into one or more different spatial directions. In an exemplary implementation, the intermediate surface 116 is a plate of any shape and is sized to hold the one or more first gaming objects.

In another exemplary implementation, the intermediate surface is connected to a linking structural member 114, which includes a counter-weight 112, to allow the intermediate surface to rise when the first gaming objects are removed, prior to resetting the triggering mechanism.

Figure 2A:
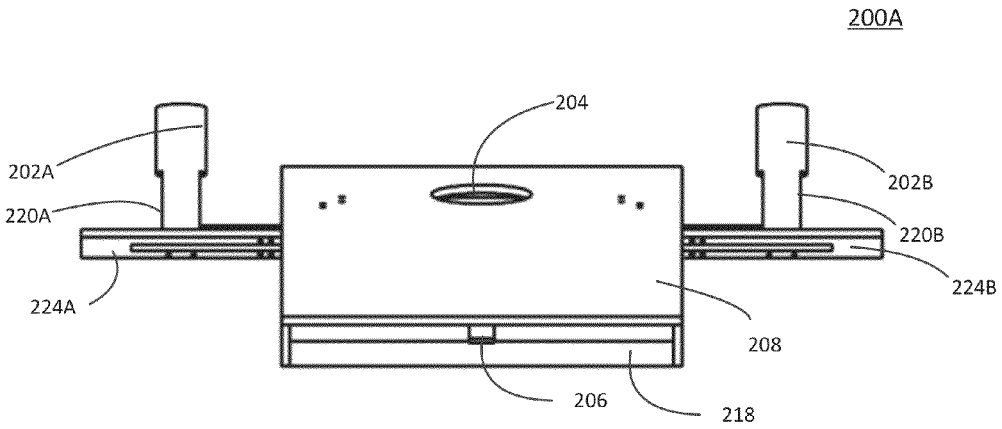
FIGS. 2A and 2B illustrate various side views of a receptacle of a gaming system in accordance with an exemplary embodiment.
Figure 2B:
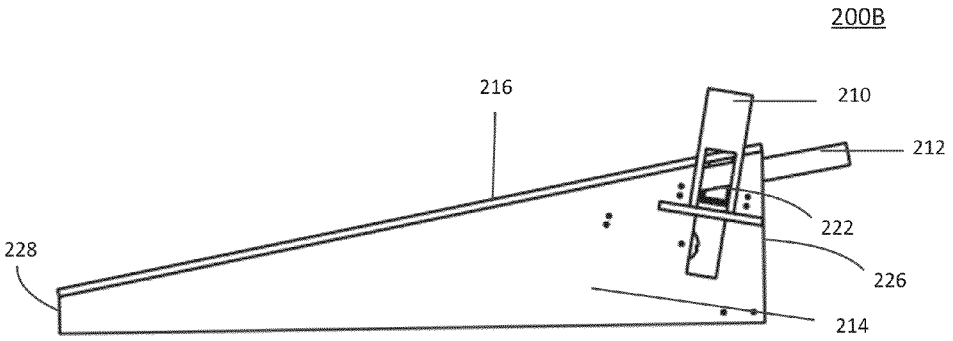

FIGS. 2A and 2B illustrate various side views of a receptacle 200A-B forming a gaming system in accordance with an exemplary embodiment. This view illustrates the one or more side surfaces 208-214 of receptacle 200A-B. This view also illustrate the sloping top surface 208-216 of the receptacle 200A-B. In this exemplary implementation, the receptacle 200A-B is shaped similar to a wedge, with four side surfaces 214 and its far side, 218 and its far side 226. The surfaces represented by 214 and its far surface are angled like a wedge, thereby slopping top surface 216 from one side of the receptacle (far side of 218 or 228), along its length 214, to the other side of the receptacle 218. Further, the views in FIGS. 2A-B illustrate the one or more holes 104, the chambers 202A-B, and the foot or hand level 206-212.

In an exemplary implementation, the partial opening 124A-B in the proximal end of the chambers 202A-B discussed with respect to FIGS. 1A-B and 2A-B is a slot 220A-B starting from the proximal end attached to the rigid member 224A-B, extending across the chamber (illustrated by the view through slot 222 of chamber 210), and extending half-way through the length of the chamber 202A-B (illustrated as the indentation 220A-B almost half-way along the length of the chamber 202A-B). The slot is smaller than at least the smallest dimension of the one or more second gaming objects and therefore retains the one or more second gaming objects within the chamber. For example, if a ping-pong ball is used, the slot does not allow the ping-pong ball to fall through the slot. However, the slot accepts, directly or indirectly, the triggering mechanism.

Figure 3:
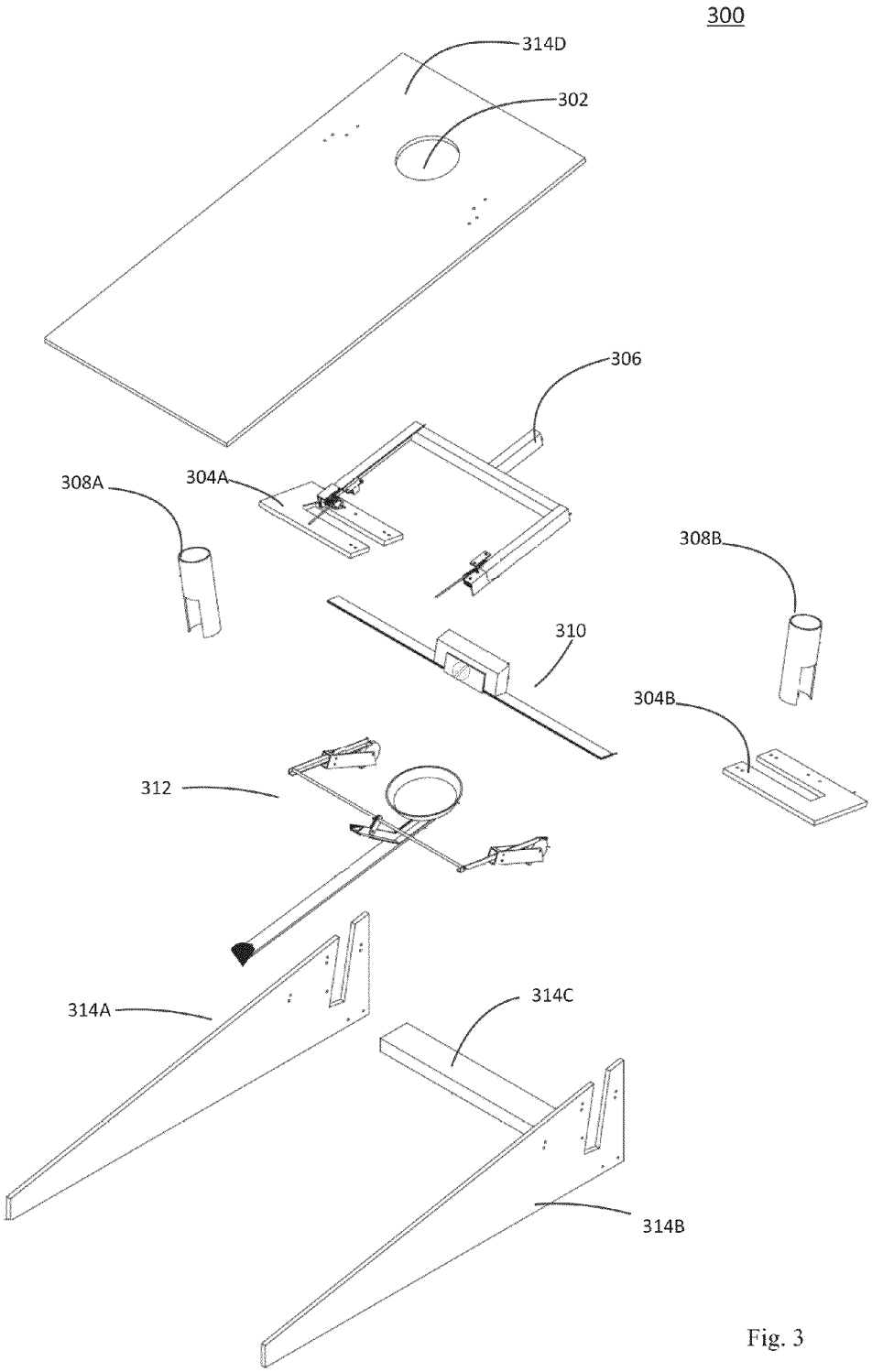
FIG. 3 illustrates a perspective view of some of the parts of a gaming system in accordance with an exemplary embodiment.

FIG. 3 illustrates a perspective view of some of the parts 300, including sub-parts 314A-D, 306, 30A-B, 310, and 304A-B, in a gaming system in accordance with an exemplary embodiment. The top, bottom and side surfaces of the receptacle are illustrated as 314A-D. There might be another side surface connecting 314A to 314B at the narrow edge of the two side planks. Further, the receptacle may be of a different shape, including cylindrical. The implementation of the figures herein are merely exemplary and illustrate four flat surfaces that form one type of receptacle. Each of parts 304A-B, 306, and 312 are fixed via one or more areas on each respective part, to the inside portions of the one or more surfaces 314A-D. However, the moving parts are free to move within or external to the receptacle. The part illustrated as 306 is the foot or hand lever that is spring-loaded. The hand or foot lever 306 is shaped like a "C" with arm members extending opposite to the lever handle. Further, the hand or foot lever 306 is fixed, at the spring sections at each end of the C-shaped arm members, to the rigid members 304A-B or an inside part of the surfaces 314A-B using screws, nuts, bolts, rivets, welds, or any suitable fixing methods. This implementation allows the hand or foot lever 306 to be depressed downwards, but allows the lever to return to its top position automatically, upon release on any depressive pressure.

In an exemplary implementation, the part illustrated as 310 is the leaf spring structure, with slat ends that are constructed from one or more layers of a spring steel. Accordingly, the leaf spring structure 310 may be bent downwards at each slat end. The center portion is fixed to the inside of the one or more surfaces 314A-B and/or 226, of the receptacle. This allows the leaf spring structure 310 to be bent by the C-shaped arm members of the foot or hand level 306. The leaf spring structure 310 is locked into notches in a wheel on receptacle part 312. This is illustrated in FIGS. 4-7 and its related discussion. The bent leaf spring forms bent slats on each end and the bent slats store a stress that may then be released to function as a triggering action related to the mechanical triggering mechanism. Throughout this disclosure, unless indicated otherwise, the term "slats" refer to the flat ends of the leaf spring structure 310, and may be used interchangeably with the term "slat ends." The slats of the released leaf spring structure 310 move into the sectional opening member on the rigid member 304A-B, through to the slots of the chambers 308A-B, and strike the second gaming objects placed within the chambers 308A-B. This causes the second gaming objects to release into one or more spatial directions.

In an alternative exemplary implementation, the slats of the leaf spring structure 310 do not move into the sectional openings of the rigid member 304A-B or through to the slots of the chambers 308A-B, but causes an air pressure, or causes a mechanical shock by hitting the chambers 308A-B. The alternative air pressure implementation makes use of differential air pressure created by an unwinding object or an object coming out of stress, which in one example, is the unbending of the slats of the leaf spring structure 310, and is sufficient to displace or release the second gaming objects into one or more spatial directions. The use of the air pressure or mechanical shock are indirect triggers caused by the trigger mechanisms to release the second gaming objects from the chambers.

Figure 4A:
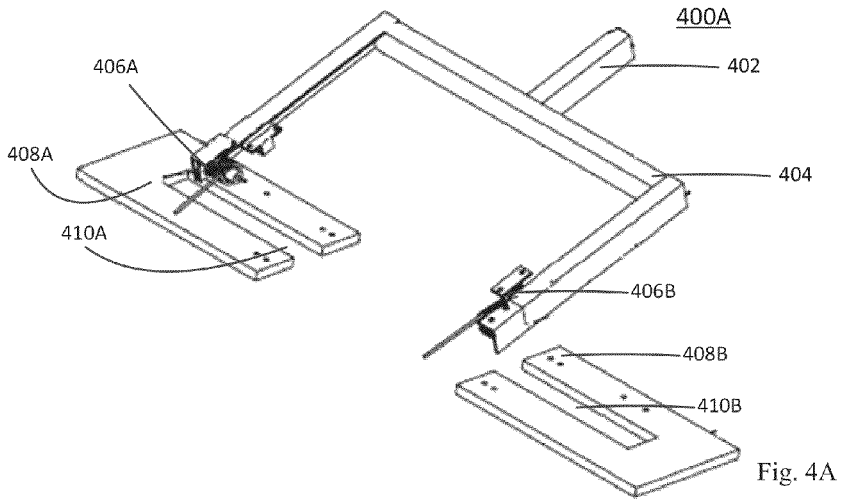
FIGS. 4A, 4B, and 4C illustrate perspective views in greater detail of certain parts that form a gaming system in accordance with an exemplary embodiment.
Figure 4B:
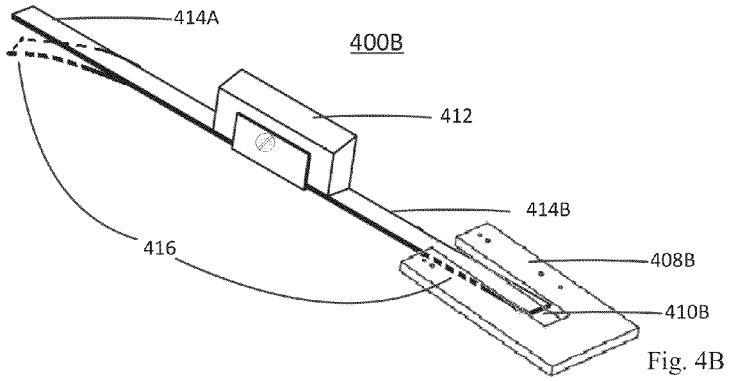
Figure 4C:
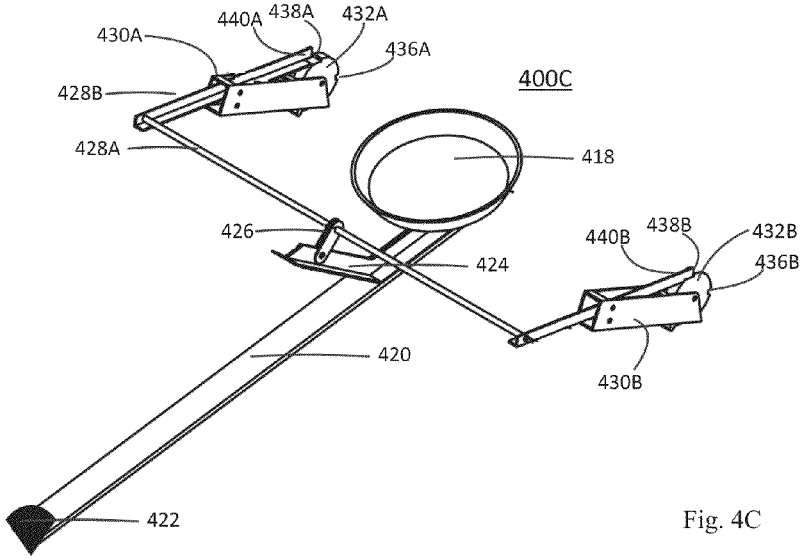

FIGS. 4A, 4B, and 4C illustrate perspective views in greater detail of certain parts 400A-C of a gaming system in accordance with an exemplary embodiment. Foot or hand lever 400A includes the lever 402, the C-shaped arm members 404, the springs 406A-B. The foot or hand lever 400A may include or be attached to the rigid members 408A-B, via its C-shaped arm members 404 and related springs 406A-B. The rigid members 408A-B are fixed to the inside of one or more of the surfaces of the receptacle as illustrated in FIGS. 1-3 and discussed above. Alternatively, the C-shaped arm members 404 and the springs 406A-B of the foot or hand lever 400A may be directly connected to one or more of the inside surfaces of the receptacle. In both examples, the foot or hand lever 400A is freely movable from a top position to a bottom position, perpendicularly with respect to the bottom surface of the receptacle. Further, the fixed springs allow the foot or hand lever 400A to automatically return to its original top position following release of any depressive pressure applied to the handle 402.

Figure 5A:
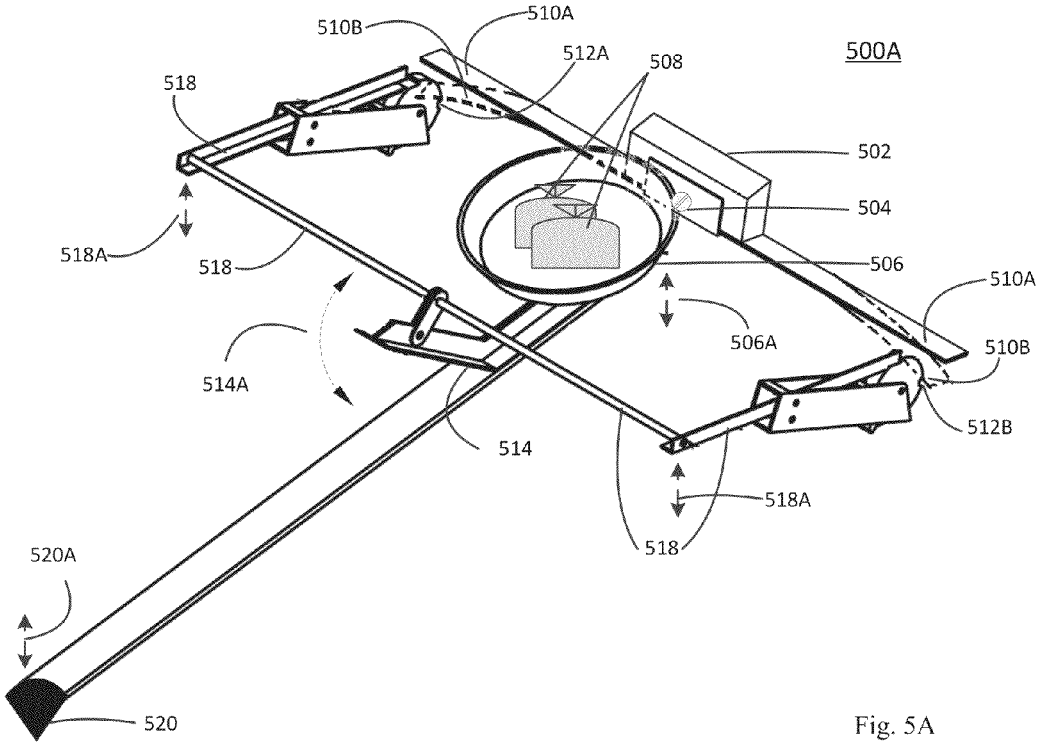
FIGS. 5A, 5B, 6, 7A, 7B, 8, 9, 10, 11A, and 11B illustrate perspective views in greater detail of certain parts of a gaming system in accordance with exemplary embodiments.
Figure 5B:
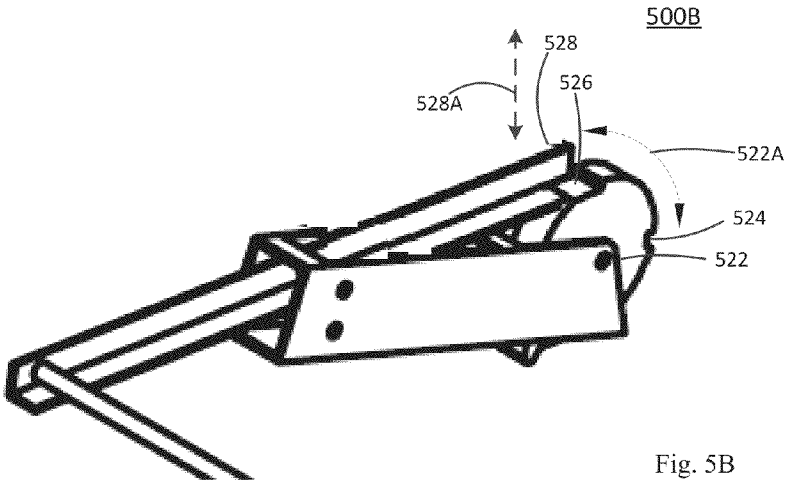
Figure 6:
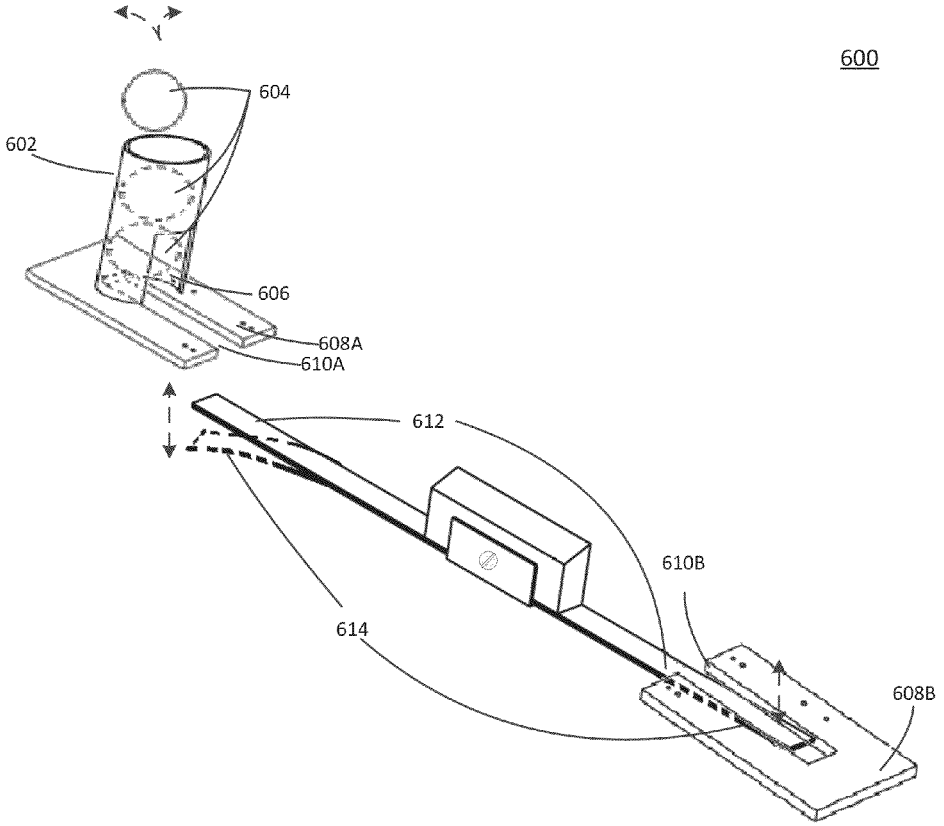

Leaf spring structure 400B is illustrated with its slats in multiple positions 414A-B and 416. At slat positions illustrated by 414A-B, the slats are passive and not stressed. Center member 412 of the leaf spring structure 400B is fixed, with any fixing previous disclosed herein, to the inside of one or more of the surfaces of the receptacle. With the center member fixed, when the foot or hand lever 400A is depressed via downward pressure at handle 402, the C-shaped arm members 404 press down on the slats 414A-B. This downward pressure depresses the slats into positions illustrated by dotted lines at 416. At this position 416, the bent slats will be locked in wheel notch 436A-B of the intermediate surface part 400C. When not in locking position, wheel notch 436A-B is typically pointed in a general upwards direction, illustrated in FIG. 7B. Throughout this disclosure, unless indicated otherwise, the phrase "releasable latch" is used interchangeable with the phrase "first notch" and represents the wheel notch 436A-B that latches the slats into a stressed position 416. When the edge of the slats 414A-B is moved down, the edge contacts into the wheel notches 436A-B and the momentum causes the wheel to rotate downwards. This allows for the edge 440A-B of the C-shaped arm structural member 428A-B of the intermediate surface part 400C to lock into locking notches 438A-B, thereby preventing the wheels from rotating upwards and releasing the stressed slats. Throughout this disclosure, unless indicated otherwise, the phrase "locking notch" is used interchangeable with the phrase "second notch" and represents the locking notch 438A-B that locks the wheels 432A-B into a locked position when the slats are in the stressed position. This is illustrated in FIGS. 5A-B and its related description. The C-shaped arm structural member 428A-B may be a "teeter-totter" member that presses against the wheels 436A-B.

In FIG. 5B, the first notch 524 is in a horizontal position, representing a latched position for bent slats 510B. The second notch 526 is locked by the edge 528 of the C-shaped arm structural member 518. When the first gaming objects 508 contact the intermediate surface 506, the intermediate surface moves 506A down, while pushing the linking members 514 and 518 down, represented by arrows 514A and 518A.

Figure 7A:
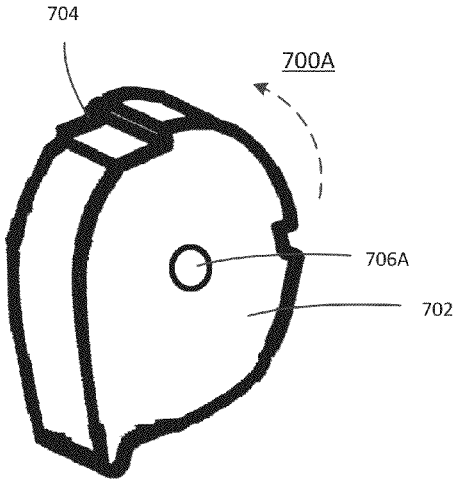
Figure 7B:
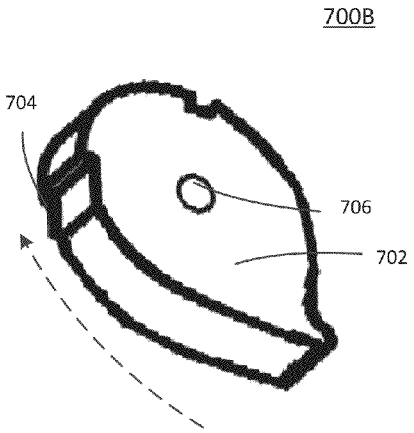

In an exemplary implementation, when the first gaming objects are received into the receptacle and retained on the intermediate surface 418, the intermediate surface 418 and the linking members 424-426 are pulled downwards (illustrated by arrows 506A and 514A) towards the bottom surface of the receptacle. The linking members 424-426 represent intermediate components of the intermediate surface that operably connects to the triggering mechanism. The linking members 424-426 pulled downwards, illustrated by arrows 514A, which in turn pushes C-shaped arm structural members 428A-B/518 upwards (arrows 518A), towards the top surface of the receptacle. This action releases the edge 528 of C-shaped arm structural member 428A-B/518 from the locking notch 438A-B and 526 (this is illustrated by arrow 528A). This causing the wheels 436A-B/522 to rotate upwards (illustrated by arrow 522A) and release the stressed slats 510B to regular position 510A. The unstressed slats move through grooves 410A-B of the rigid members 408A-B, and strikes the second gaming objects. Alternatively, the mere pressure difference or the mechanical shock of the unstressed slats may indirectly cause the second gaming objects to release from the chambers and move into one or more spatial directions. Following the removal of the first gaming objects from the intermediate surface 418, the counter-weight 422/520 allows the intermediate surface to move back to its top (or unloaded) position, illustrated by 520A. It is appreciated that a physical link between the counter-weight 422/520 and the two wheels 436A-B may also be used to return the wheels to an unlocked position, with the releasable latch 524 pointed upwards as illustrated in FIG. 7B. Wheel holders 430A-B are fixed to the inside surfaces of the receptacle to hold the intermediate surface part 400C in a firm position.

FIGS. 5A-B, and 6-8 further illustrate perspective views in greater detail of certain parts 500A-B and 600-800 of a gaming system in accordance with one or more exemplary embodiments. In another exemplary implementation, a gaming method and associated scoring is illustrated by FIGS. 5-8. FIG. 5A illustrates the spring leaf member 400B with its slats in a stressed position 510B and unstressed position 510A. The center member 502 is a fixed member as disclosed above, using a fixing component 504, which may be a screw, nut, rivet, weld, or any suitable combination of a fixing component and method. The gaming method includes, storing, in one or more chambers 602/816 of a receptacle, one or more second gaming objects 604/818. In one step, the method includes setting (illustrated via arrows 522A, 518A of FIG. 5), within the receptacle, a triggering mechanism, such as the bent slats 510B of the leaf spring structure into a mechanically releasable latch 512A-B or into an electrically "off" state of blower 808A-B. However, an action of one or more first gaming objects 508 falling onto the intermediate surface 506/802 within the receptacle causes activation of the triggering mechanism, mechanically or electrically, whereby the bent slat is mechanically unlatched to position 510A or the electric blowers 808A-B are switched to an "on" operation. This allows direct or indirect access of the triggering mechanism to the sectional opening members 610A-B of rigid members 608A-B or via blowing holes type of sectional openings members 812A-B of rigid members 810A-B. The blowing holes type of a sectional opening member are primarily shaped to avoid loss of blowing pressure from the blowers below the rigid surface. FIGS. 7A-B illustrate the positions of the wheel in the locked latch position 700A and the unlocked position 700B.

Figure 8:
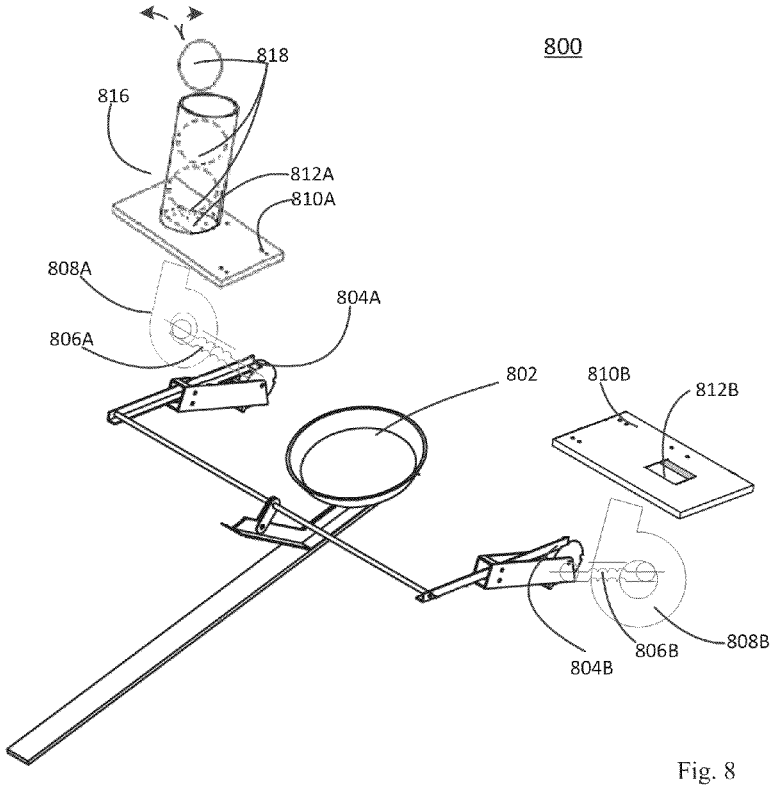

The intermediate surface 506/802 is operably attached to the triggering mechanism as illustrated in FIGS. 5A and 8. Further, the game method includes, receiving, through the hole in the receptacle, the one or more first gaming objects 508 thrown at, rolled, or dropped into the hole. Thereafter the game method receives and retains, on the intermediate surface 506/802, the received one or more first gaming objects 508 from the hole. The intermediate surface causes activation of the triggering mechanism, where the triggering mechanism is unlatched from the mechanically releasable latch 524 or is electrically switched from an "off" state to an "on" state (with respect to the blowers 808A-B). Further, the game features releasing, directly or indirectly by the triggering mechanism, the one or more second gaming objects 604/818 into one or more spatial directions. The game is typically scored by the number of the one or more second gaming objects 604/818 retrieved at one or more of: during the game, during a predetermined time, or prior to the one or more second gaming objects touching any surface of any environmental object. An environmental object may represent any object in the vicinity of the gaming system, including the receptacle and the parts of the gaming system except the first and second gaming objects themselves. "During the game," is representative of each time the trigger mechanism is triggered, while a predetermined time may be set by the players of the game.

In an exemplary implementation, the second notch of the wheel 804A-B includes an electric switch that is connected to blowers 808A-B and switches them "off" or "on." Considering the implementation of the electrical triggering mechanism with respect to part 400C in FIG. 4 or related sections of FIG. 8, when the edges 440A-B of the C-shaped structural member 428A-B are released from the releasable latch 438A-B, electric switches within the second notch (similar to 804A-B) switch to an "on" state and the blower is turned on, releasing the balls into one or more directions. When the edges 440A-B are set into back into notch 804A-B, the gaming system is returned to an unstressed state with the blowers 808A-B switched "off" Alternatively, the blowers typically switch to the "off" state automatically after a period of time upon triggering, allowing all the second gaming objects to release prior to switching "off" Thereafter, the blowers are reset by returning the edge of C-shaped arm structural member to the locking notch. The blowers 808A-B are fixed to the inner part of the one or more surfaces of the receptacle. In an alternate implementation, the blowers are powered by a battery instead of an power plug port for AC/DC current, thereby allowing the gaming system to be moved outdoors and carried to any external location of play.

FIG. 9 illustrates perspective views, in greater detail, or certain parts 900A-D of a gaming system in accordance with other exemplary implementations. Each of the parts 900A-C includes a rigid members 912 and sectional opening member 906, which may also include the side member 906A illustrated in part 900D. The sectional opening member 906 is part of a triggering mechanism, where the second gaming objects 908 are loaded into the chamber 914, which includes spring 902. Spring 902 gets compressed which the sectional opening member 906 is slid into place covering the distal end opening of the chamber 914. When the triggering mechanism is activated, the wheel 920 rolls upwards and a linking member 910 acts on the sectional opening member 906 via the optional side member 906A or directly, causing the sectional opening member 906 to be removed into alignment, where the sectional opening 904 is in line with the distal end opening of the chamber 914, as illustrated in parts 900A-B. Alternatively, the sectional opening member 906 is completely removed to allow the spring to decompress and propel the one or more second gaming objects 908 into one or more different directions.

In another exemplary embodiment, the side member 906A of the sectional opening member 906 allows a linking member 910 to pull the side member 906A and sectional opening member 906 to side open or flip open, as illustrated in part 900D. Part 900C illustrates a partially enclosed frame including the rigid member 912 and side members 926, the side members including grooves 924 for the sliding sectional opening member 906 to side and roll downwards. In the case the sectional opening member 906 is implemented to flip open, then the grooves 924 provides the support to hold the sectional opening member 906 in a closed position. In part 900D the dotted line representing part 906 is the sectional opening member in an flip-open state. When the sectional opening member is opened, the spring decompresses, as in parts 900A-B, and propels the one or more second gaming objects 908 into one or more different directions. In each of 900A-C, the triggering mechanism includes the edge 918 of the structural member 922 locked into the notch 924 on the wheel 920, as well as the wheel 920 connected to the sectional opening member 906-906A, and optionally, through rigid member 912. Some of 922, 906-906A, and 910 of the triggering mechanism are intermediate components between the intermediate surface and the triggering mechanism, wherein the intermediate surface is depressed to operably trigger the trigger mechanism, the trigger mechanism directly or indirectly propelling the one or more second objects into one or more spatial directions. The sectional opening members throughout this disclosure may not be rigid and may be flexible compared to the rigid member. Furthermore, the sectional opening members throughout this disclosure are illustrated as rectangular, but may be shaped like a circular disc, like a square, or a spherical shaped object. In some exemplary implementations, the rigid member is of the same shape as the sectional opening member. Further, both the sectional opening member and the rigid member may be irregularly shaped, and the rigid member may be an attachment structure between each chamber and one or more surfaces of the receptacle, such as a metal, plastic, or wooden nut and bolt assembly or any interlocking mechanism (e.g., with a male-female interlock) for rigidly connecting the chamber to the receptacle.

In other exemplary implementations, the sectional opening member 906 is placed directly above or directly below the rigid member. When the sectional opening member 906 is placed directly above the rigid member, it is a part of the rigid member and supports the proximal end of the chamber 914. The sectional opening member 906 may be slid aside, allowing the triggering mechanism to directly or indirectly cause the propulsion of the one or more second gaming objects, through the open distal end of the one or more chambers, into one or more different spatial directions. In an example, when the blowers 808A-B of FIG. 8 are activated, the sectional opening members are slid aside simultaneously or by a delay, to then allow the electrical triggering mechanism (blowers 808A-B in an "on" state) to indirectly access the proximal end of the chambers, by blowing air into the chambers causing the propulsion of the one or more second gaming objects, through the open distal end of the one or more chambers, into one or more different spatial directions. Further, in an exemplary implementation, when the activated triggering mechanism directly or indirectly causes propulsion of the one or more second gaming objects, the triggering mechanism is causing a force to directly or indirectly propel the one or more second gaming objects or is part of the releasing lid that propels the one or more second gaming objects by releasing the one or more second gaming objects from an enclosed stressed chamber, such as the chambers illustrated in parts 900A-C of FIG. 9.

Figure 10:
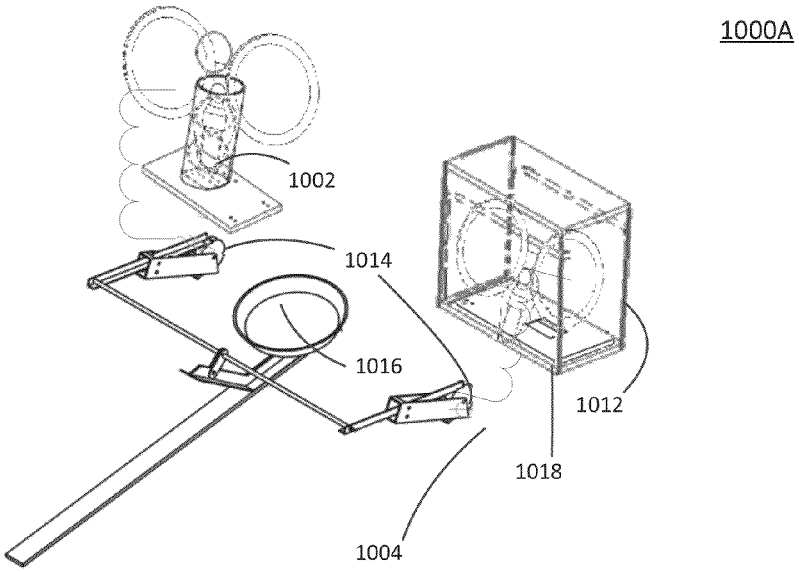
Figure 10:
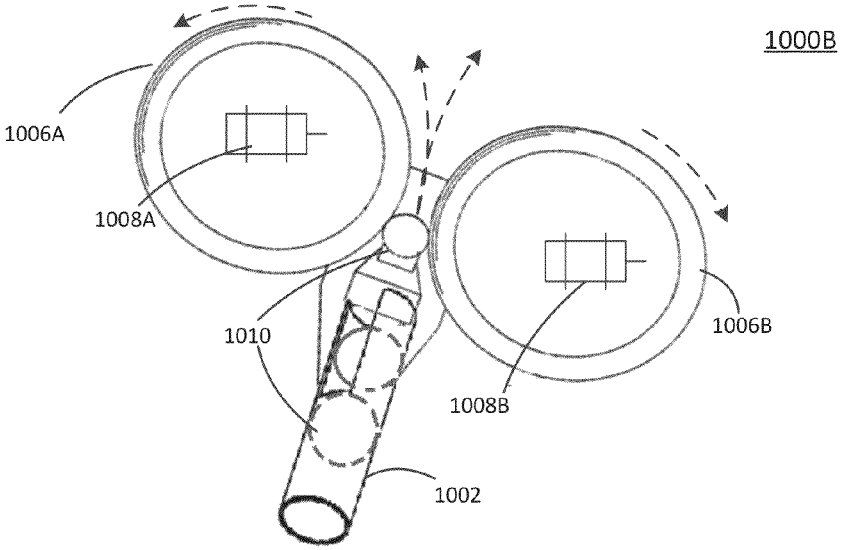

Another exemplary implementation is illustrated in FIG. 10, via parts 1000A-B of a gaming system in accordance with an exemplary embodiment. Part 1000A illustrates the chambers 1002 including second gaming objects 1010 loaded within the chambers. An electrical throwing apparatus 1000B is part of the electrical triggering mechanism. The electrical throwing apparatus 1000B is triggered from an "off" state to an "on" state, when the intermediate surface 1016 is weighed down by one or more first gaming objects, similar to the implementation of the electrical blowers described above. In this case, the connecting wires 1004 are connected to wheel 1014 and act to pass an electric current from an electrical switch within the wheel 1014 to the one or more motors 1008A-B. When the intermediate surface 1016 is weighed down, the wheel 1014 rotates and the electrical switch is switched on, causing the one or more motors 1008A-B to trigger into an "on" state. The one or more motors 1008A-B causes motorized opposing rollers 1006A-B to roll in the directions illustrated by the broken arrows. The second gaming objects 1010 are sucked into the grip of the rollers and are propelled out of the electrical throwing apparatus 1000B into one or more different spatial directions. However, in the absence of a trigger, the intermediate surface 1016 is in a higher position, and the electrical throwing apparatus 1000B is in an electrically "off" state. The electrical throwing apparatus 1000B and the chambers 1002 may be fixed into the rigid member 1018 at the bottom of the frame 1012. The frame 1012 is directly fixed to the receptacle as disclosed in 200A-B via the sides 214 (and its far side), or indirectly via the rigid member 1018 at its bottom. Further, each of various structural components disclosed herein, throughout this disclosure, are made from such materials as wood, metal, rubber, plastic, or a combination of the four, wherein the material is selected based on the required dimensions and utility of the corresponding structure. The wheels 1006A-B typically include a gripping surface made of rubber.

Figure 11A:
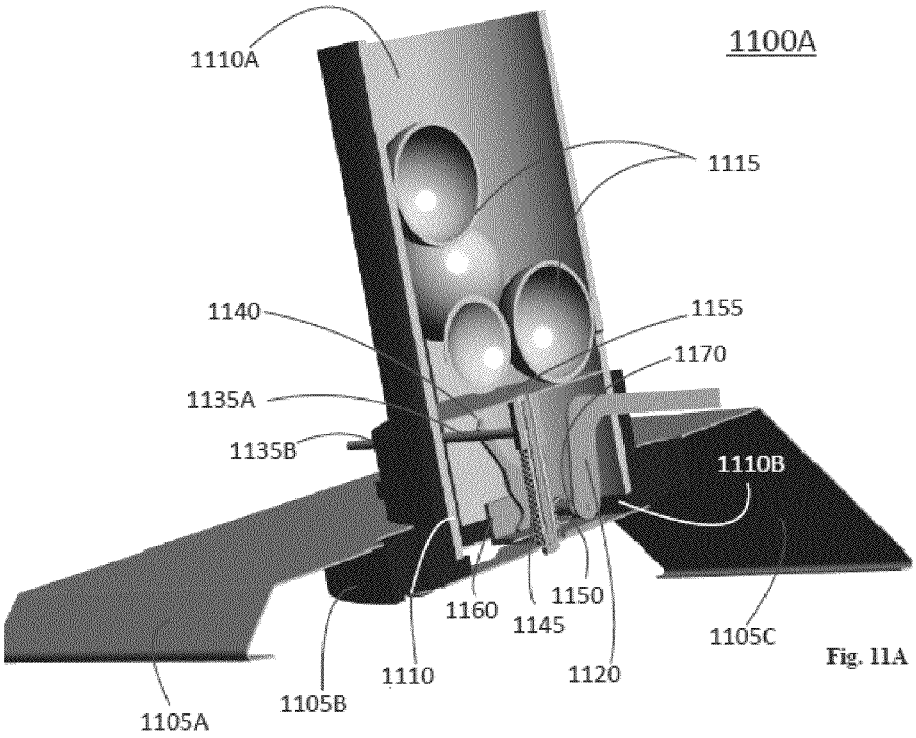
Figure 11B:
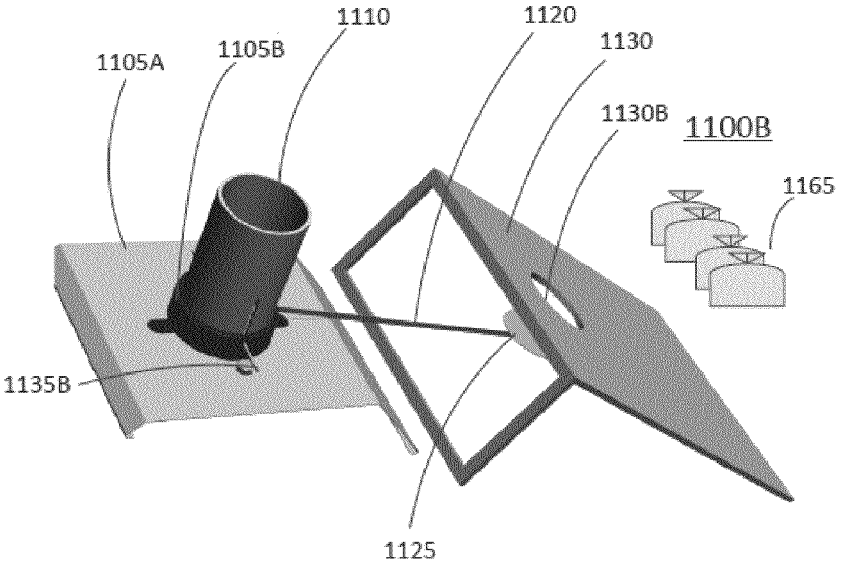

In a further exemplary implementation, FIGS. 11A-B illustrate perspective views of gaming system 1100A-B in accordance with an aspect of this disclosure. In an exemplary implementation, the gaming system 1100A-B is applicable as the side chambers 202 and rigid members 224 of the system in FIGS. 1 and 2. The gaming system 1100A-B includes an intermediate surface 1125 (similar to component 418 of FIG. 4) operably connected to a rigid member 1105 (similar to component 408 of FIG. 4). A person of ordinary skill in the art would appreciate from this disclosure that the rigid member 1105 may include one or more components (e.g., 1105A-C) attached together by a permanent, semi-permanent, or removable engineering method, such as a weld, latches, screws, or riveted joints. In an example, without limitation, the rigid member 1105 may include base 1105B, and stabilizing frame portions 1105A and 1105C.

The intermediate surface 1125 is connected to a frame portion 1160 of the rigid member 1110 via a connecting member 1120, rod 1170, and a first spring 1150. The rod 1170 (similar to component 420 of FIG. 4C) is anchored to the frame portion 1160 via first spring 1150, which allows the intermediate surface 1125, the connecting member 1120, and the rod 1170, to pivot radially in relation to the axis of the rod 1170. This allows the intermediate surface 1125 to move up and down, which then forces the releasable latch 1140 to pivot in an out from latching releasably with the structural member 1135A. These movements cause the latching or releasing between the releasable latch 1140 the structural member 1135A. A person of ordinary skill in the art would understand from this disclosure that the intermediate surface 1125 is anchored to the rigid member 1110, but is pilotable to perform the latching or releasing of the releasable latch 1140, which forms part of the triggering mechanism. The intermediate surface 1125 is therefore operably connected to the rigid member 1110.

Further, in an example, the parts of the triggering mechanism include a sectional opening member 1155, a structural member 1135A, the first spring 1150, a second spring 1145, and the releasable latch 1140. The triggering mechanism is configured to activate upon receipt of one or more first gaming objects 1165 on the intermediate surface 1125. The one or more chambers 1110 is operably connected to the rigid member 1105 via the base structure 1105B, The chamber 1110 receives and stores one or more second gaming objects 1115. Further, the single chamber 1110 is illustrated to represent each of the one or more chambers that may be attached to the rigid member and to one or more of the triggering mechanisms. A person of ordinary skill would appreciate from this disclosure that the same triggering mechanism may be extended to work in more than one chamber by providing extended members branching from the connecting member 1120. Further, the chamber 1110 has an open distal end 1110A through which to receive or release the one or more second gaming objects 1115, and a proximal end 1110B through which to receive or include the triggering mechanism, including the components described above.

In an exemplary implementation, the proximal end 1110B is illustrated as open to the base 1105B, where the rigid member supports the triggering mechanism. In another exemplary implementation, the base structure may be part of the proximal end 1110B, which is partially open at the bottom to allow air into the chamber 1110. As described with previous embodiments, including the illustrations of FIG. 8, the partial opening would allow air to indirectly access the one or more second gaming objects 1115, and to propel the one or more second gaming objects 1115 through the open distal end 1110A of the one or more chambers, into one or more different spatial directions.

Further, the rigid member 1105 is positioned operably with a receptacle 1130. The receptacle 1130 may have closed side or may be constructed as a basic frame structure, with open sides, as illustrated in FIG. 11B. However, the basic function of the receptacle, to receive the one or more first gaming objects 1165, is preserved. The top surface of the receptacle 1130 may include one or more holes 1130B, such as illustrated in the figure. The hole 1130B allows the one or more first gaming objects 1165 to be received on the intermediate surface 1125, through the hole 1130B. Accordingly, a person or ordinary skill would understand from this disclosure that, in order to be operable with the receptacle 1130, the rigid member 1105 is positioned such that the intermediate surface 1125 receives the one or more first gaming objects 1165. Further, the rigid member 1105 may be positioned on the sides of the receptacle 1130, as illustrated in FIGS. 1A-B and 2A-B.

Still further, the receipt of the one or more first gaming objects 1165 on the intermediate surface 1125 causes activation of the triggering mechanism to directly or indirectly access the chamber 1110. For example, the releasable latch 1140 is illustrated as connected to the intermediate surface 1125 via connecting member 1120, the rod 1170, and the first spring 1150, in accordance with one arrangement. The first spring 1150 is a torsion spring that is arranged such that the releasable latch 1140 is ordinarily pressed against the structural member 1135A. This holds the sectional opening member 1155 in a stressed state, away from the distal end 1110A of the chamber 1110, Accordingly, the second spring 1145 in also in a squeezed or stressed position. When the first gaming objects 1165 fall on the intermediate surface 1125, the intermediate surface 1125 is pulled down, causing the first spring 1150 to rotate in a radial release direction, with respect to its longitudinal axis, thereby pulling the releasable latch 1140 upwards.

The sectional opening member 1155 is connected to the structural member 1135 and to the second spring 1145, The structural member 1135 has an internal section 1135A and external section 1135B. The external section 1135B may be used to cock or reset the sectional opening member 1155 and second spring 1145 into the stressed position once the game is restarted and the one or more second gaming objects 1115 are back in the chamber. The second spring 1145 is movable in an axial release direction along the longitudinal axis of the chamber 1110. The axial release direction would motion the sectional opening member 1155 upwards through the chamber 1110, propelling the one or more second gaming objects 1115 through the open distal end 1110A.

Further, the sectional opening member 1155 is configured for latching via the structural member 1135A and the releasable latch 1140, and when the first and second springs 1145-1150 are held in their respective stressed positions. The structural member 1135A and the releasable latch 1140 may be latched to each other using retaining notches or other similar latching structures prepared on the structural member 1135A. The notches may be similar to the notches illustrated on the wheels in FIGS. 7A-B. Still further, the releasable latch 1140 is configured for release from latching by the receipt of the one or more first gaming objects 1165 on the intermediate surface 1125. As a result, the first spring 1150 unwinds and releases the releasable latch 1140 into the radial release direction, upwards, which then causes the second spring 1145 to unwind and to move the sectional opening member 1155 in the axial release direction upwards. These motions cause the one or more second gaming objects 1115 to propel through the open distal end 1110A of the chamber 1110.

A person of ordinary skill would understand from this disclosure that air pressure within the chamber, forced or sucked in, through the partially open proximal end 1110B may be sufficient to move a light second gaming object 1115, such as a ping-pong ball. In such applications, the upward movement of the sectional opening member 1155 provides sufficient air displacement to indirectly propel the second gaming object 1115 out of the chamber 1110. Accordingly, the disclosure herein contemplates an activated triggering mechanism for directly or indirectly causing the propulsion of the one or more second gaming objects 1115, through the open distal end 1110A of the one or more chambers 1110, into one or more different spatial directions.

Each of the implementations, whether using mechanical or electrical triggering and resetting methods, disclosed herein, allow players to interact with the system and with each other. This allows players to mix the type of second gaming objects, such as to include combinations of light weight ping-pong balls and high-bounce balls that will trick an opposing player during the scoring phase, as the balls may respond differently on release from the chambers. Each different type of second gaming objects may have different physical and mechanical properties, such as beanbags, which have a changing shape, or high-bounce balls, which have a highly elastic mechanical property. Furthermore, the intermediate surface may be adjusted to trigger the release only when certain number of first gaming objects are received and retained at the intermediate surface. These playing options allows a level of unpredictability and interaction in the game, between players and the gaming system.

The exemplary methods and acts described in the implementations presented previously are illustrative, and, in alternative implementations, certain acts can be performed in a different order, in parallel with one another, omitted entirely, and/or combined between different exemplary implementations, and/or certain additional acts can be performed without departing from the scope and spirit of the disclosure. Accordingly, such alternative implementations are included in the disclosures described herein.

Although specific implementations have been described above in detail, the description is merely for purposes of illustration. It should be appreciated, therefore, that many aspects described above are not intended as required or essential elements unless explicitly stated otherwise. Various modifications of, and equivalent acts corresponding to, the disclosed aspects of the exemplary implementations, in addition to those described above, can be made by a person of ordinary skill in the art, having the benefit of the present disclosure, without departing from the spirit and scope of the disclosure defined in the following claims, the scope of which is to be accorded the broadest interpretation so as to encompass such modifications and equivalent structures.

What is claimed is:

1. A gaming system comprising:

a receptacle with a top surface, a bottom surface, and one or more side surfaces, wherein the top surface comprises one or more holes, the one or more holes for allowing the receptacle to receive one or more first gaming objects;

one or more chambers to receive and store one or more second gaming objects, each of the one or more chambers having an open distal end through which to receive or release the one or more second gaming objects and a closed or at least partially open proximal end, the one or more chambers attached to a rigid member;

the rigid member attached to the one or more surfaces of the receptacle and having an optional sectional opening member coincidental with the proximal end or the open distal end of each of the one or more chambers, the rigid member allowing a triggering mechanism, which is attached to a mechanically releasable latch or is in an electrically "off" state, to directly or indirectly access the proximal end of the one or more chambers, when triggered;

an intermediate surface within the receptacle, the intermediate surface operably connected to activate the triggering mechanism and anchored to an inside portion of one or more of the surfaces of the receptacle; and the intermediate surface to receive and retain the one or more first gaming objects received into the receptacle, wherein the receipt of the one or more first gaming objects on the intermediate surface causes activation of the triggering mechanism to directly or indirectly access the rigid member and the one or more chambers, and wherein the activated triggering mechanism directly or indirectly causes propulsion of the one or more second gaming objects, through the open distal end of the one or more chambers, into one or more different spatial directions.

2. The gaming system of claim 1, wherein the receptacle has four flat side surfaces.

3. The gaming system of claim 1, wherein the receptacle is shaped similar to a wedge, with four side surfaces, and with the top surface sloped from one side of the receptacle, along its length, to the other side of the receptacle.

4. The gaming system of claim 1, wherein one or more of the top surface, the bottom surface, and the one or more side surfaces are made from one or more individual panels of wood, plastic, rubber, or metal, and optionally, with gaps there between.

5. The gaming system of claim 1, wherein at least one of the one or more chambers is a cylindrically-shaped chamber.

6. The gaming system of claim 1, wherein the at least partially open proximal end of each chamber is a slot starting from the proximal end, extending laterally across the chamber, and extending half-way through the length of the chamber;

wherein the slot is smaller than the smallest dimensions of the one or more second gaming objects and therefore retains the one or more second gaming objects within the chamber; and wherein the slot accepts, directly or indirectly, the triggering mechanism.

7. The gaming system of claim 1, wherein the first gaming objects are small bags comprising a filler and are sized to fit into the hole.

8. The gaming system of claim 7, wherein the small bags are made of one or more of cloth, leather, and a synthetic material.

9. The gaming system of claim 7, wherein the filler is one or more of polystyrene beads, dried beans, metal pellets, wood pellets, and foam.

10. The gaming system of claim 1, wherein the one or more second gaming objects are spherical objects or bags comprising fillers.

11. The gaming system of claim 1, wherein the one or more second gaming objects are one or more of ping-pong balls, sponge balls, golf balls, beanbags, and high-bounce balls.

12. The gaming system of claim 1, wherein the intermediate surface is a plate of any shape and is sized to hold the one or more first gaming objects.

13. The gaming system of claim 1, wherein the opening in the rigid member accepts, directly or indirectly, the triggering mechanism.

14. The gaming system of claim 1, wherein the triggering mechanism is one or more of a slat under bending stress; an air pressure created by an unwinding object or an object coming out of stress; an electric blower with "on-off" capability; an electric throwing apparatus comprising motorized opposing rollers with a gap there between; a material under elastic stress; a magnetically or electromagnetically induced release; a compressed spring at the proximal end of each chamber and a removable cover over its distal opening; and a spring under compression.

15. The gaming system of claim 1, wherein the releasable latch is a first notch in a rotatable wheel, which rotates in a radial release direction of the triggering mechanism, the rotatable wheel held in a latched position with an edge of a structural member releasably locked into a second notch of the wheel, wherein the edge of the structural member is operably connected to the intermediate surface, and wherein the edge of the structural member is released from the second notch when the intermediate surface receives the one or more first gaming objects, thereby causing the wheel to rotate and to release the latch from the first notch into the radial release direction, and causing the triggering mechanism to, directly or indirectly, propel the one or more second gaming objects through the open distal end of the one or more chambers.

16. The gaming system of claim 1, wherein the triggering mechanism is configured to be reset or cocked by a foot or hand lever, wherein the foot or hand lever is connected to a spring-loaded structural member, and wherein depressing the foot or hand lever mechanically latches the triggering mechanism into a stressed state or electrically switches the triggering mechanism into an "off" state, thereby resetting the triggering mechanism.

17. The gaming system of claim 1, wherein the triggering mechanism is configured to indirectly access the at least partially open proximal end of the one or more chambers using air from an electric blower, which is in an electrically switched "on" state during activation, thereby blowing air to release the one or more second gaming objects, through the open distal end of the one or more chambers, into one or more different spatial directions.

18. The gaming system of claim 1, wherein the triggering mechanism is configured to directly access the at least partially open proximal end of the one or more chambers using a bent slat, which mechanically de-stress during activation, thereby straightening into the at least partially open proximal end of the one or more chambers and striking the one or more second gaming objects to push it through the open distal end of the one or more chambers, into one or more different spatial directions.

19. The gaming system of claim 1, wherein each chamber is spring-loaded and the sectional opening member is configured to function as a removable lid latched in the mechanically releasable latch, each chamber holding the one or more second objects in a stressed state, and wherein activation of the triggering mechanism directly or indirectly acts to remove the lid or move the sectional opening member into a position to allow the one or more second gaming objects to propel into one or more different directions.

20. The gaming system of claim 1, wherein the triggering mechanism is adjustable in the mechanically releasable latch or in the electrically "off" state to activate only when a predetermined number of first gaming objects are received on the intermediate surface.

* * * * *